United States Patent [19]

Fujimoto

[11] Patent Number: 5,046,240

[45] Date of Patent: Sep. 10, 1991

[54] METHOD OF TERMINATING WIRE WOUND TYPE NOISE PREVENTING RESISTANCE CABLE

[75] Inventor: Terutsugu Fujimoto, Mie, Japan

[73] Assignee: Sumitomo Wiring System, Ltd., Mie, Japan

[21] Appl. No.: 558,243

[22] Filed: Jul. 26, 1990

[30] Foreign Application Priority Data

Aug. 7, 1989 [JP] Japan ..... 1-205507

[51] Int. Cl.[5] ..... H01R 43/00

[52] U.S. Cl. ..... 29/857; 156/52; 338/214; 439/877

[58] Field of Search ..... 174/74 R; 338/214; 439/125, 126, 877; 156/51, 52

[56] References Cited

U.S. PATENT DOCUMENTS 3,266,008 8/1966 Elliott .
3,284,751 11/1966 Barker et al. ..... 338/214 X
3,319,210 5/1967 Sandone, Jr. et al. ..... 439/877 X
3,518,606 6/1970 Barker et al. ..... 338/214 X
3,787,800 1/1974 Barker et al. ..... 338/214 X
3,813,643 5/1974 Hartz .

FOREIGN PATENT DOCUMENTS 273413 7/1988 European Pat. Off. ..... 156/52

*Primary Examiner*—Carl J. Arbes
*Attorney, Agent, or Firm*—Wenderoth, Lind & Ponack

[57] ABSTRACT

The end portion of a wire wound noise preventing resistance cable in which a resistance wire is transversely wound around a core formed from an elastomeric compound is terminated such that the resistance wire is fully embedded in the core by applying heat and high pressure to the leading end that remains exposed after the cable is cut and the end portion thereof is stripped of a covering layer. This construction of the end portion of the core prevents unraveling of the resistance wire and maintains a good electrical connection between the resistance wire and a metal terminal.

2 Claims, 2 Drawing Sheets

METHOD OF TERMINATING WIRE WOUND TYPE NOISE PREVENTING RESISTANCE CABLE

BACKGROUND OF THE INVENTION:

1. Field of the Invention

The present invention relates to an improved method of terminating a wire wound noise preventing resistance cable, which is used in the ignition system for an automotive engine, after the cable has been cut and stripped of an outer insulating cover at an end thereof.

2. Statement of the Prior Art

Generally, there are two types of method of terminating a wire wound noise preventing resistance cable. One method is referred to as a "contact pin type" method in which an electrical connection between a solderless terminal and a resistance wire is attained via a contact pin disposed at the end of the resistance wire. The other method is referred to as a "folding type" method in which a direct electrical connection between the terminal and the resistance wire is attained by removing an outer insulating cover from the end of the cable to expose a wire wound core therein and folding back the exposed wire wound core over the cable. The "contact pin type" method consumes labor in disposing a pin at the end of the resistance wire, and a superior electrical connection can be attained with the "folding type" method. Thus, the latter terminating method has been used more frequently. For example, the folding and connecting structure of a strand type resistance wire is disclosed in U.S. Pat. Nos. 3,787,800 and 3,266,008.

However, in a case where the "folding type" method is used for terminating a wire wound type resistance cable, the resistance wire easily unravels when the end portion of the wire is stripped of the outer insulating cover, thereby causing leakage problems.

In addition, it is known that a magnetic substance is included in the core of the cable of this type so as to improve the noise preventing capability. However, there is a drawback in that if a great quantity of such a magnetic substance is included in the core, the tensile strength and extensibility of the core is deteriorated, and cracks are generated during the terminating operation when the leading end of the wire wound core is folded back over the cable, the resistance wire being thereby broken.

A general connecting structure for the end portion of a wire wound noise preventing resistance cable is disclosed in U.S. Pat. No. 3,518,606, but there is no disclosure there in with regard to a method of preventing such unraveling of the resistance wire.

In order to solve the above drawbacks, the development of a new resistance cable has been desired in which the resistance wire is prevented from unraveling when removing the outer insulating cover from the end thereof, and in which the core has good mechanical properties, such as a high tensile strength and so forth.

The inventor of the present invention discloses a method of manufacturing a resistance cable in which a resistance wire can be wound around a core in compact fashion at a uniform pitch, and in which the resistance wire is prevented from unraveling, in the official gazette of Japanese Patent Public Disclosure No. 16891/1988.

In the cable manufactured in accordance with the method disclosed in the above official gazette, since the core is made from a fluorine rubber compound by extruding the same in an unvulcanized state, and since a resistance wire is wound around the core so made, the resistance wire is partly embedded in the surface of the core. Due to this construction, with the resistance cable disclosed in the official gazette, even when extruding from an insulating cover, as well as when removing the insulating cover from the end of the resistance cable, the resistance wire that is wound around the core in a compact fashion is prevented from being displaced and/or unraveling. In addition, although fluorine rubber is a compound that contains a great quantity of magnetic substance, it remains superior with regard to its tensile strength, extensibility and so forth, even after it has been vulcanized, and thus the core is made free from the above-mentioned cracking problem.

However, although it is possible to solve the unraveling problem arising at the time of removing the outer insulating cover, it often happens that during a cable-terminating operation after the removal of the outer insulating cover, particularly when a solderless terminal is manually press fitted over the end of the cable, that the hand of a worker touches the exposed wire wound core, thereby often causing the leading end of the resistance wire to unravel. With a view to solving the above-mentioned problem, an adhesive is conventionally applied to the leading end of the wire wound core that is exposed when removing the outer insulating cover so as to prevent unraveling.

However, with this method in which an adhesive is applied to the wire wound core, there are drawbacks in that the application of the adhesive to the wire wound core takes time and in that electrical connection errors between the terminal and the resistance wire are caused due to the application of adhesive to the portions which require no adhesive, thus making the quality of a product unstable.

SUMMARY OF THE INVENTION

An object of the present invention is to obtain a method of terminating a wire wound noise preventing resistance cable in which unraveling of a resistance wire is well prevented and in which a proper electrical connection between the resistance wire and a metal terminal is well maintained.

The present invention is characterized in that a resistance wire wound around a core formed from an elastometric compound is fully embedded in the core when the core is subjected to a plastic deformation by applying heat and high pressure to the exposed leading end of the wire wound core after a resistance cable having therein such a core is cut and stripped of the outer insulating cover.

It is preferable that the elastomeric compound used is a fluorine rubber compound.

When applying heat and high pressure to the leading end of the wire wound core, the core is softened and subjected to a plastic deformation. When the core is thus deformed, the resistance wire wound around the deformed core is then fully embedded in the core, thus preventing the unraveling of the resistance wire from the leading end of the core. The electrical connection with the terminal is attained by the resistance wire wound around the portion of the core where the above-mentioned heat and high pressure is not applied.

DETAILED DESCRIPTION OF THE PREFERRED EMBODIMENTS

Referring to FIGS. 1 to 4, an embodiment of a method of terminating a wire wound noise preventing resistance cable according to the present inventin will now be described.

Figure 2:
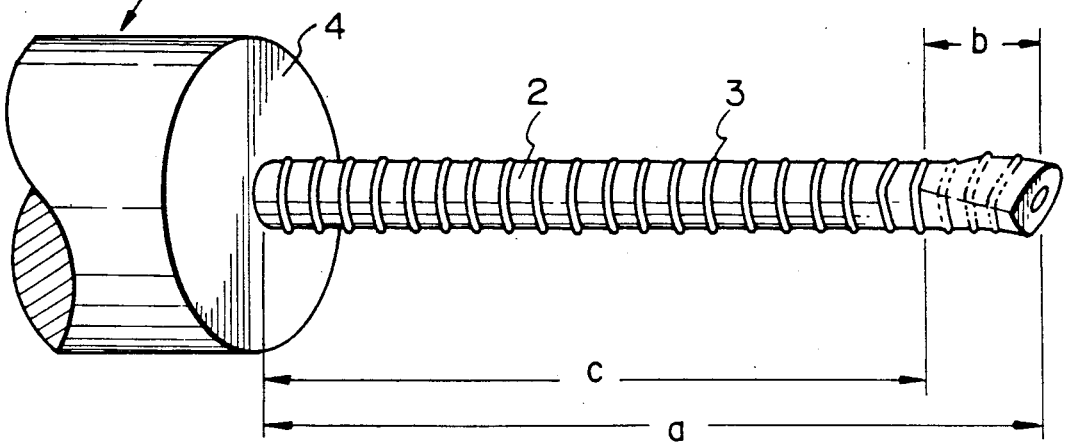
FIG. 2 is an enlarged cross-sectional view showing the portion of a cable that is terminated by utilizing the terminating method of the present invention.
Figure 4:
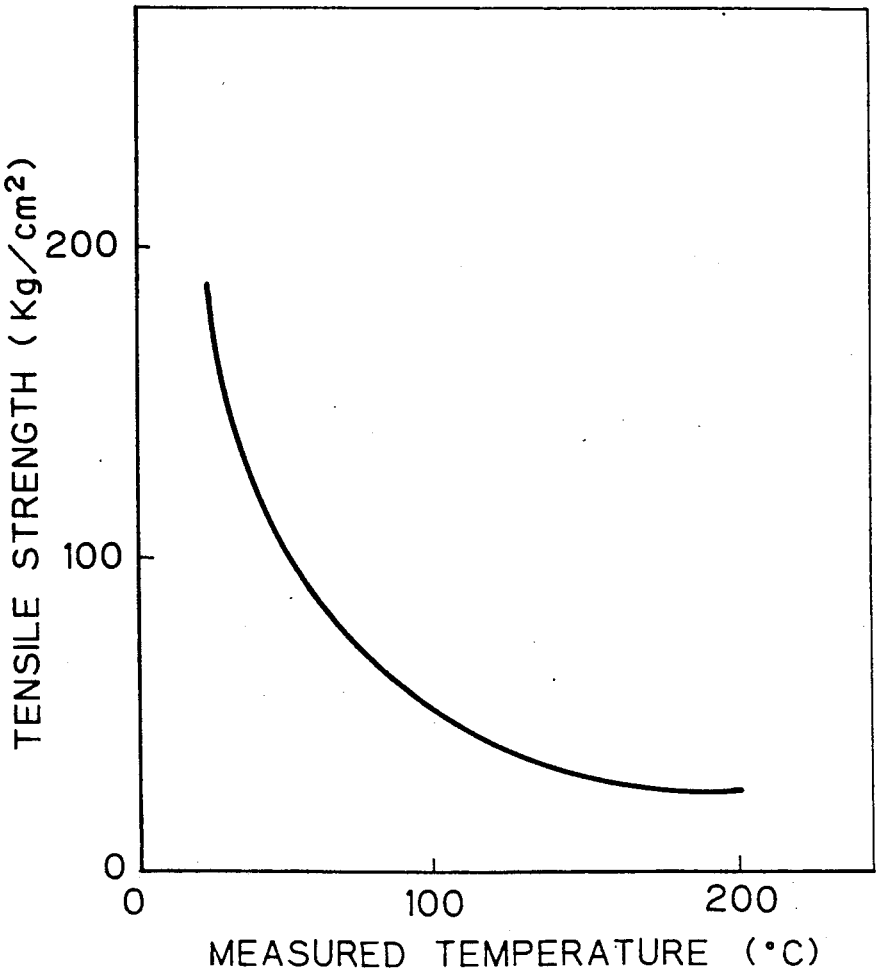
FIG. 4 is a graph showing the temperature characteristics of a fluorine rubber used in the embodiment of the present invention.

In FIG. 2, reference numberal 1 denotes a wire wound noise preventing resistance cable. A core 2, around which a wire 3 is wound, of the cable 1 is formed from a fluorine rubber compound containing a certain quantity of ferrite [ferrite:fluorine rubber=400:100 (part by weight ratio)]. The temperature characteristics of a fluorine rubber (produced by ASAHI GLASS CO., LTD.: AFRAS) used in the embodiment of the present invention are shown in FIG. 4.

The core 2 is extruded and formed in an unvulcanized state, and a resistance wire 3 is transversely wound around the core 2 in such a manner that the resistance wire 3 is partly embedded in the core 2. In addition, a covering layer 4 comprising an insulation layer, a braid, a sheath and so forth is provided over the wire wound core 2, and afterwards, the cable so formed is vulcanized.

Figure 1:
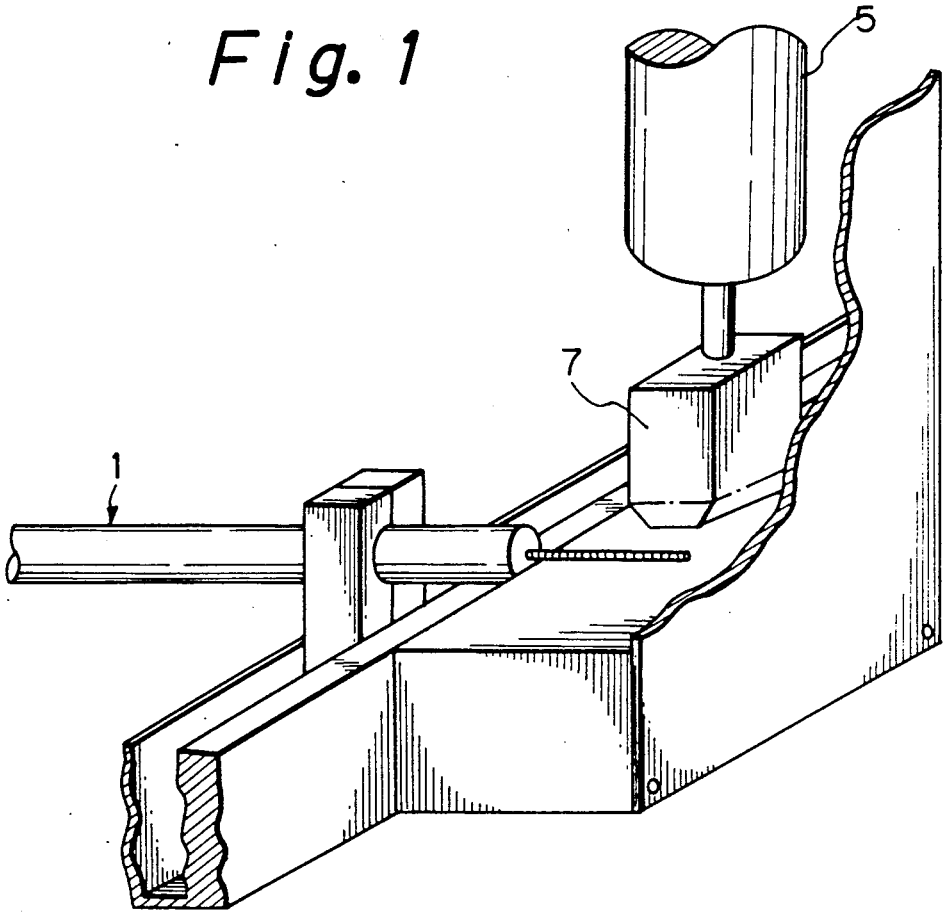
FIG. 1 shows an apparatus for carrying out an embodiment of a terminating method according to the present invention.

As shown in FIG. 2, the cable 1 formed as described above is cut, and the covering layer 4 is removed from the end portion a (about 15 mm) of the cable 1 so as to expose the core 2 around which the resistance wire 3 is wound. The leading end b (about 3 mm) of the exposed end portion a is crushed by means of a press machine 5 as shown in FIG. 1.

Figure 3:
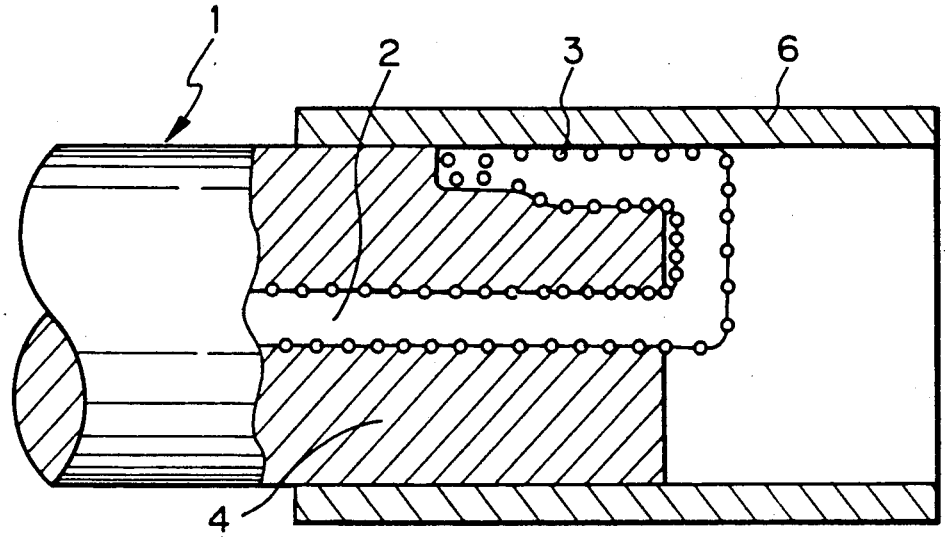
FIG. 3 is an enlarged cross-sectional view showing the portion of the cable over which a metal solderless terminal is fitted.

Subsequently, the exposed end portion a of the wire wound core 2 is folded back over the cable 1 as shown in FIG. 3, and a metal terminal 6 is press fitted thereover. An electrical connection between the metal terminal 6 and the wire wound core 2 is attained via the portion c of the wire wound core 2 where the resistance wire 3 remains exposed.

The press machine 5 is mounted on a cable cutting and stripping machine, and the cable 1 is automatically conveyed to the press machine 5 by means of a conveyor or the like after the covering layer 4 is removed from the end portion a thereof so as to be pressed.

A heater, as a heating source, is installed in an upper die 7 of the press machine 5, and the upper die 7 is vertically moved by a hydraulic cylinder of the like. The temperature of the heater, pressing time and pressing pressure are adjusted such that the fluorine rubber compound constituting the core can be plastically deformed so that the resistance wire is fully embedded in the core. In the embodiment of the present invention, the high-pressing time, pressing pressure and the temperature for heating the portion to be crushed are 0.5 seconds, 4 kg/cm$^2$ and 100° C., respectively.

In this embodiment, a fluorine rubber compound having superior mechanical properties is used as the best material for the core. However, other elastomers such as chlorinated polyethylene, polyolefin resin, EPDM rubber, silicone rubber and so forth may also be used.

With the terminating method of the present invention, since the resistance wire may be fully embedded in the core only at the leading end, the resistance wire on the exposed portion of the core is prevented from unraveling even after the cable is cut and stripped of the covering layer, and an electrical connection between the press fitted metal terminal and the resistance wire can be attained as in the case of the prior art cables.

In addition, the conventional process of applying an adhesive may be omitted.

What is claimed is:

1. A method of terminating a wire wound noise preventing resistance cable, the cable including a core formed of an elastomeric material, a resistance wire traversely wound around the core, and a covering layer surrounding the core and resistance wire, said method comprising:

stripping the covering layer from the core and resistance wire at an end of the cable to expose a length of the core and resistance wire;

applying heat and pressure to an end portion of the exposed length of the core and resistance wire until the resistance wire is entirely embedded in the core at the end portion of the exposed length.

2. A method as recited in claim 1, wherein the elastomeric material is a fluorine rubber compound.

* * * * *